United States Patent [19]

Sakamoto et al.

[11] 4,449,484

[45] May 22, 1984

[54] HOT WATER SUPPLY SYSTEM

[75] Inventors: Moriyoshi Sakamoto; Toshihiko Saito, both of Yokohama, Japan

[73] Assignee: Tokyo Shibaura Denki Kabushiki Kaisha, Kanagawa, Japan

[21] Appl. No.: 444,367

[22] Filed: Nov. 26, 1982

[30] Foreign Application Priority Data

Nov. 30, 1981 [JP] Japan ..... 56-192194

[51] Int. Cl.[3] ..... F22B 5/00

[52] U.S. Cl. ..... 122/13 R; 122/31 A; 122/17; 122/367 R; 126/361

[58] Field of Search ..... 122/13 R, 19, 14–18, 122/31 A, 134, 45–48, 135 F, 157, 158, 367 A, 367 C, 367 R; 126/361

[56] References Cited

U.S. PATENT DOCUMENTS

| | | | |
|---|---|---|---|
| 1,531,348 | 3/1925 | Richardson | 122/17 |
| 1,810,774 | 6/1931 | Mackley | 122/17 |
| 1,832,332 | 11/1931 | Stone | 122/17 |
| 1,845,581 | 2/1932 | Coakley | 122/17 |
| 1,904,511 | 4/1933 | Mutrux et al. | 122/13 R |
| 2,218,422 | 10/1940 | Haddock | 122/17 |
| 3,091,223 | 5/1963 | Vitale | 122/17 |
| 3,490,420 | 1/1970 | Kramer | 122/17 |
| 4,253,426 | 3/1981 | Nishi et al. | 122/13 R |

FOREIGN PATENT DOCUMENTS

| | | |
|---|---|---|
| 55-72704 | 5/1980 | Japan . |
| 55-102804 | 8/1980 | Japan . |

OTHER PUBLICATIONS

Turbo Pulse Seal Co., Ltd. Technical Data.

*Primary Examiner*—Henry C. Yuen

*Attorney, Agent, or Firm*—Cushman, Darby & Cushman

[57] ABSTRACT

A hot water supply system comprises a base of cylindrical shape; a storage tank supported on the base, the tank having an upper end plate and a lower end plate supported on the base and defining, together with an inner face of the base, a soundproofing chamber; and a pulse combustor including a pulse burner attached to the lower end plate, and a tail pipe which communicates with the burner and is arranged inside the storage tank next to the lower end plate, the tail pipe having an ascending portion extending from the pulse burner toward the upper end plate, and a descending portion extending from a top end of the ascending portion toward the lower end plate to guide condensed water condensed inside the tail pipe to outside the storage tank. The system further comprises a blower, a suction muffler, and an exhaust muffler which are arranged inside the soundproofing chamber, the base having a soundproofing layer to shield noise generated in the soundproofing chamber.

16 Claims, 3 Drawing Figures

HOT WATER SUPPLY SYSTEM

BACKGROUND OF THE INVENTION

The present invention relates to a hot water supply system and, more particularly, to a storage-type hot water supply system with a pulse combustor.

A pulse combustor has long been known as a combustor of high combustion efficiency. A pulse combustor comprises a pulse burner having a combustion chamber, and an elongate pipe, a so-called tail pipe, which communicates with the exhaust side of the combustion chamber. A pulse combustor is a combustor which operates similarly to a two-cycle engine and performs intermittent combustion at predetermined cycles. Exhaust gas is exhausted while it is pulsed within the tail pipe.

A pulse combustor as described above has the following advantages. Air and fuel gas are automatically fed to the combustion chamber due to a negative pressure generated within the combustion chamber of the pulse burner. Therefore, a blower or fan for supplying air is not required (except at the start of the operation of the combustor), and the blower can be of compact size. High load combustion can be performed, and a combustion chamber of small size can be used. Since the fuel gas is pulsed within the tail pipe as described above, a thermal transfer coefficient of about 3 to 5 times that of a conventional combustor may be obtained if such a tail pipe is used as a heat exchanger. The pulse combustor has other advantages. However, since the pulse combustor has high combustion efficiency as described above, it has a problem of creating excessive noise.

In a conventional hot water supply system which uses a pulse combustor as a heating source, a pulse burner of the pulse combustor is mounted at the upper portion of a storage tank. The tail pipe extends from the upper portion of the storage tank toward the lower portion thereof and then extends outside the tank from the lower portion thereof. This tail pipe is used as a heat exchanger. The exhaust gas which is passed through the tail pipe is cooled by a liquid within the storage tank and is condensed. Condensed water is thus produced within the tail pipe. In order to facilitate smooth discharge of the condensed water in the conventional hot water supply system of the type described above, the pulse burner of the pulse combustor is mounted on the upper portion of the storage tank and the tail pipe extends from the upper portion of the storage tank to the lower portion thereof. The conventional hot water supply system further has, for the purpose of reducing noise, a suction muffler which is arranged at the upper portion of the storage tank and which is connected to the combustion chamber, and an exhaust muffler which is arranged beneath the storage tank and which is connected to the exhaust side of the tail pipe. The storage tank, the suction and exhaust mufflers, and the pulse combustor are covered with a soundproofing material such as concrete.

In a hot water supply system of the type described above, the pulse burner and the suction muffler of the pulse combustor are arranged at the upper portion of the storage tank, while the exhaust muffler is arranged beneath the tank, providing a bulky overall system. Furthermore, since the pulse burner and the tail pipe of the pulse combustor (which are sources of noise) are present almost throughout the entire body of the system, soundproofing is difficult. Since the overall system is covered with a soundproofing material, the system becomes even more bulky and does not allow easy access for maintenance.

SUMMARY OF THE INVENTION

The present invention has been made in consideration of these problems and has for its object to provide a hot water supply system, which is compact in size, and which is capable of easily eliminating noise.

According to one aspect of the present invention, there is provided a hot water supply system comprising: a base of substantially cylindrical shape; a storage tank supported on the base, the storage tank having an upper end plate with a hot water outlet port, and a lower end plate supported by the base and defining, together with an inner face of the base, a soundproofing chamber; a pulse combustor having a pulse burner which is attached to the lower end plate and which has a combustion chamber, and a tail pipe which communicates with the combustion chamber, is arranged inside the storage tank next to the lower end plate, and functions as a heat exchanger, the tail pipe having an ascending portion which extends from the pulse burner toward the upper end plate, and a descending portion which extends from a top end of the ascending portion toward the lower end plate and into the soundproofing chamber through the lower end plate to guide condensed water condensed inside the tail pipe to outside the storage tank; a blower which is arranged inside the soundproofing chamber and which supplies air to the combustion chamber of the pulse burner when the pulse burner is started; a suction muffler which communicates with the blower and which is arranged inside the soundproofing chamber; and an exhaust muffler which communicates with the descending portion of the tail pipe and which is arranged inside the soundproofing chamber. The base has a soundproofing layer and shields noise generated inside the soundproofing chamber.

In the hot water supply system of the present invention as described above, the pulse combustor, the suction muffler, the blower and the exhaust muffler are concentrated at the lower portion of the storage tank. For this reason, the hot water supply system of the present invention can be made compact in size as compared with conventional systems. In particular, the pulse combustor and the mufflers which are the sources of noise are concentrated at the lower portion of the storage tank as described above. Accordingly, the noise may be easily reduced by the base which is arranged below the storage tank. The hot water supply system of the present invention need not be entirely covered with a soundproofing material as in a conventional system and can therefore be made compact in size. Although the pulse combustor is mounted at the lower portion of the storage tank in the system of the present invention, the condensed water produced inside the tail pipe may be smoothly discharged since the tail pipe has a descending portion.

DETAILED DESCRIPTION OF THE PREFERRED EMBODIMENTS

The first embodiment of the present invention will first be described in detail with reference to the accompanying drawings.

Figure 1:
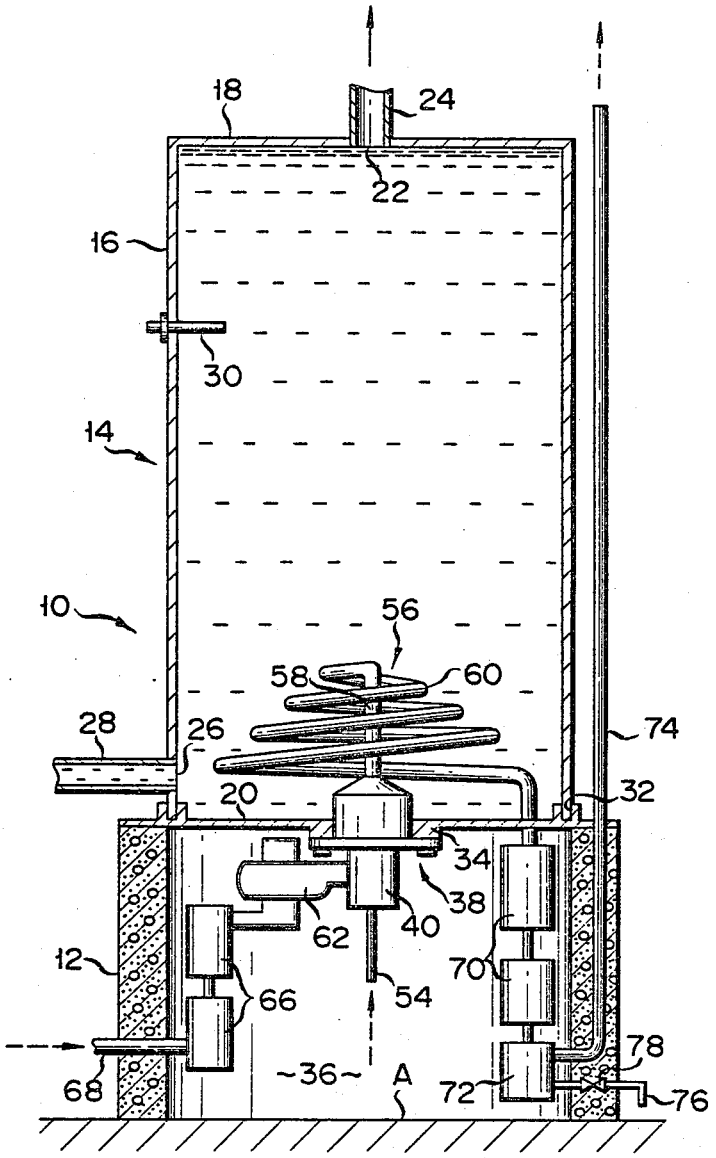
FIG. 1 is a vertical sectional view of a hot water supply system according to the first embodiment of the present invention.

Referring to FIG. 1, a hot water supply system 10 has a cylindrical base 12 with two open ends. The base 12 is made of a soundproofing material such as concrete. The base 12 is placed on floor A and its lower end is closed thereby. The hot water supply system 10 further has a storage tank 14 supported on the base 12. The storage tank 14 has a cylindrical circumferential wall 16, an upper end plate 18 closing the upper end opening of the wall 16, and a lower end plate 20 closing the lower end opening of the wall 16. A hot water outlet port 22 is formed in the upper end plate 18, and a hot water discharge pipe 24 is connected to the port 22. A water inlet port 26 is formed in the wall 16 near the lower end plate 20, and a water supply pipe 28 is connected to the port 26. A thermostat 30 for detecting the temperature of a liquid held inside the storage tank 14 is mounted in the wall 16 near the upper end plate 18. The lower end plate 20 has an annular engaging groove 32 which engages with the lower edge of the wall 16. Thus, the lower end plate 20 is detachably attached to the wall 16. The lower end plate 20 further has a boss 34 which projects downward from the substantially central portion thereof. The lower end plate 20 is mounted on the upper peripheral edge of the base 12 to thereby support the storage tank 14 on the base 12. The lower end plate 20 further seals the upper end of the base 12 and, together with the inner face of the base 12, defines a soundproofing chamber 36.

Figure 2:
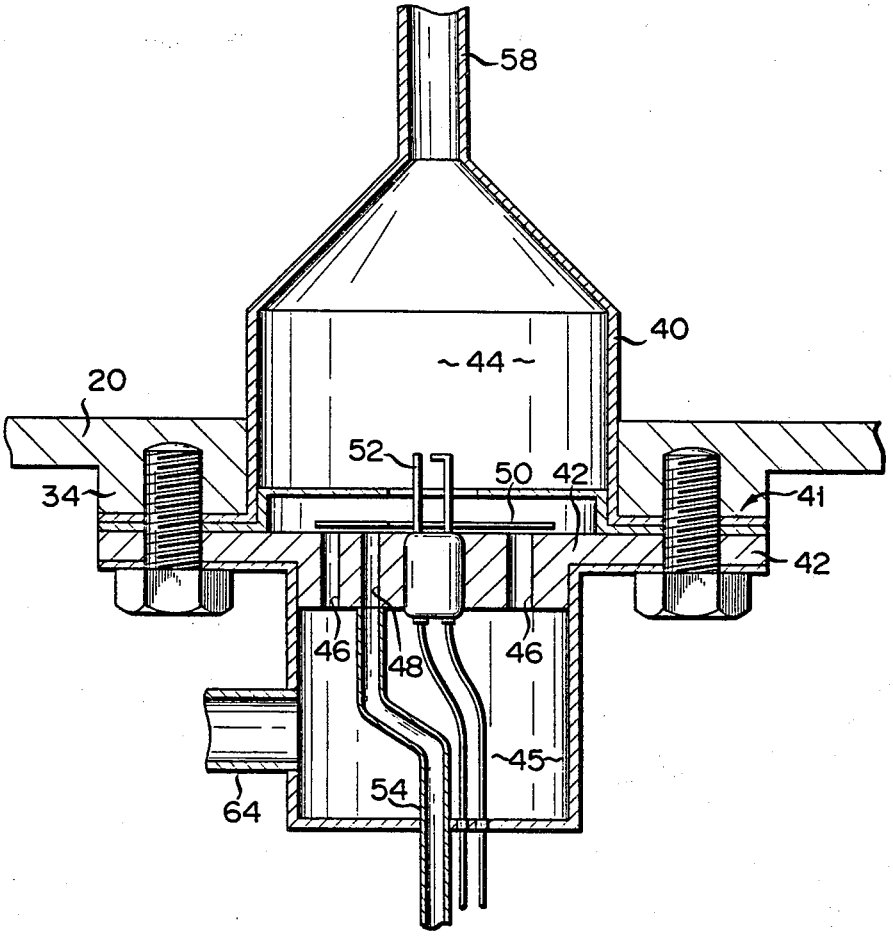
FIG. 2 is a vertical sectional view of a pulse burner of the system shown in FIG. 1.

The hot water supply system 10 further has a pulse combustor 38. As shown in FIGS. 1 and 2, the pulse combustor 38 has a pulse burner 40 which is attached to the lower end plate 20. The pulse burner 40 has an outwardly extending flange 41, which is securely fixed to the boss 34 of the lower end plate 20 with screws. The upper half of the pulse burner 40 projects into the storage tank 14 through the lower end plate 20, while the lower half thereof is positioned inside the soundproofing chamber 36. The pulse burner 40 has a base plate 42 which separates the interior of the pulse burner 40 into a combustion chamber 44 (upper half) and an air chamber 45 (lower half). The base plate 42 has a gas hole 48 and a plurality of air holes 46 extending through the base plate 42. The ends of the gas hole 48 and the air gas holes 46 opening to the combustion chamber 44 are opened/closed by a flap valve 50. An ignition plug 52 is mounted on the base plate 42 to extend into the combustion chamber 44. A gas pipe 54 is connected to the end of the gas hole 48 opening to the air chamber 45 and extends downward to be connected to a fuel gas supply device (not shown).

The pulse combustor 38 has a tail pipe 56 which communicates with the combustion chamber 44 of the pulse burner 40 and which is arranged inside the storage tank 40 adjacent to the lower end plate 20, and serves as a heat exchanger. The tail pipe 56 has an ascending portion 58, which communicates with the combustion chamber 44 of the pulse burner 40 and which extends substantially vertically upward from the pulse burner 40 toward the upper end plate 18. The tail pipe 56 further has a descending portion 60, which extends from the extended end of the ascending portion 58 toward the lower end plate 20. The descending portion 60 extends spirally outward and downward around the ascending portion 58. The terminal end of the descending portion 60 extends into the soundproofing chamber 36 through the lower end plate 20.

The hot water supply system 10 has a fan 62 which is arranged as a blower inside the soundproofing chamber 36. A nozzle 64 of the fan 62 communicates with the air chamber 45 of the pulse burner 40. A pair of suction mufflers 66 are arranged inside the soundproofing chamber 36 and are series-connected to the suction side of the fan 62. A suction pipe 68 is connected to the lower suction muffler 66, and extends outside the base 12 therethrough. A pair of exhaust mufflers 70 and a drain tank 72 are further arranged inside the soundproofing chamber 36 and are series-connected to the terminal end of the descending portion 60 of the tail pipe 56. An exhaust pipe 74 is connected to the drain tank 72 and extends through the base 12 and then upward alongside the storage tank 14. A drain pipe 76 is connected to the drain tank 72 and extends outside the base 12 therethrough. Reference numeral 78 denotes a solenoid valve for opening/closing the drain pipe 76.

The mode of operation of the hot water supply system 10 of the construction as described above will now be described.

When the fan 62 is driven, combustion air is supplied to the air chamber 45 of the pulse burner 40 through the suction pipe 68 and the suction mufflers 66 and then to the combustion chamber 44 through the air holes 46. Simultaneously, fuel gas is supplied to the combustion chamber 44 through the gas pipe 54 and the gas hole 48 from the fuel gas supply device (not shown). The combustion air and the fuel gas are mixed inside the combustion chamber 44 and are combusted upon being ignited by the ignition plug 52. Then, the pressure inside the combustion chamber 44 is rendered positive; the flap valve 50 is urged to close the gas hole 48 and the air holes 46, and the exhaust gas is supplied to the tail gate 56. When the exhaust gas is supplied to the tail pipe 56, the pressure inside the combustion chamber 44 is rendered negative. Then, the flap valve 50 receives suction to open the gas hole 48 and the air holes 46 so that the combustion air and the fuel gas are sucked into the combustion chamber 44. At this time, the exhaust gas supplied to the tail pipe 56 is also sucked toward the combustion chamber 44 by the negative pressure inside the combustion chamber 44, and part of the exhaust gas flows into the combustion chamber 44. Since the exhaust gas which has flown into the combustion chamber 44 in this manner is at a high temperature, the gas mixture inside the combustion chamber 44 is automatically ignited and combusted. Thereafter, intermittent combustion is performed automatically without requiring operation of the fan 62 and the ignition plug 52.

The exhaust gas supplied to the tail pipe 56 flows therein as a pulsed fluid and is supplied to the exhaust mufflers 70. The exhaust gas noise is reduced by the exhaust mufflers 70 and is exhausted to the outside from the exhausted pipe 74 through the drain tank 72. The tail pipe 56 is heated by the exhaust gas to exchange heat with the liquid inside the storage tank 14, thereby heating this liquid. While the exhaust gas flows inside the tail pipe 56, it is gradually cooled by the liquid inside the storage tank 14 and is condensed. Condensed water is thus produced inside the descending portion 60 of the tail pipe 56. The length of the ascending portion 58 of the tail pipe 56 is so set that the exhaust gas may condense within the descending portion 60. The condensed water is guided through the descending portion 60 to the outside of the storage tank 14, and is supplied through the exhaust mufflers 70 to the drain tank 72. In order to improve the effects of the exhaust mufflers 70, the solenoid valve 78 arranged in the drain pipe 76 is closed during the operation of the pulse combustor 38. When the pulse combustor 38 is inoperative, the solenoid valve 78 is opened. Then, the condensed water in the drain tank 72 is drained outside the base 12 through the drain pipe 76.

The hot water supply system 10 according to the first embodiment as described above has the following advantages.

The pulse combustor 38, the fan 62, the suction mufflers 66 and the exhaust mufflers 70 are concentrated at the lower portion of the storage tank 14. Therefore, the system 10 can be made compact in size as compared with conventional systems. The lower half of the pulse burner 40, the suction mufflers 66 and the exhaust mufflers 70 are arranged within the soundproofing chamber 36 defined by the lower end plate 20 and the base 12. The base 12 is made of a soundproofing material such as concrete. Accordingly, noise generated by various parts inside the soundproofing chamber 36 is shielded. In this manner, since the pulse burner 40, the suction mufflers 66, the exhaust mufflers 70, and so on, are concentrated at the lower portion of the storage tank 14, the noise may be easily eliminated by the base 12. The upper half of the pulse burner 40 and the tail pipe 56 are arranged inside the storage tank 14, and the noise generated thereby is attenuated by the liquid held inside the storage tank 14. For this reason, the noise generated by the pulse burner 40 and the tail pipe 56 hardly penetrates to outside the storage tank 14. Since the system 10 is compact in size and is capable of eliminating the noise, it may be easily used for household and industrial applications.

The tail pipe 56 serving as a heat exchanger is arranged at the lower portion of the storage tank 14. Therefore, convection tends to be caused in the storage tank 14 so that the liquid held therein may be efficiently heated. The tail pipe 56 has the ascending portion 58 and the descending portion 60, and the descending portion 60 extends spirally downward from the top end of the ascending portion 58 toward the lower end plate 20. The area of heat exchange is sufficient. The descending portion 60 extends spirally downward from the top end of the ascending portion 58 toward the lower end plate 20, that is, inclined downward. The condensed water produced inside the descending portion 60 can flow to the outside of the storage tank 14 along the descending portion by its own weight. Additionally, the exhaust gas pressure inside the tail pipe 56 is as high as about 800 mm Aq, and the condensed water inside the descending portion 60 is smoothly exhausted under the pressure of the exhaust gas. Although the pulse combustor 38 is arranged at the lower portion of the storage tank 14, the condensed water produced in the tail pipe 56 is smoothly exhausted. The lower end plate 20 is detachably attached to the wall 16. Therefore, when the pulse burner 40 or the like goes out of order, the lower end plate 20, together with the pulse burner, may be removed from the wall 16, thus facilitating easy replacement of the parts or the like.

Figure 3:
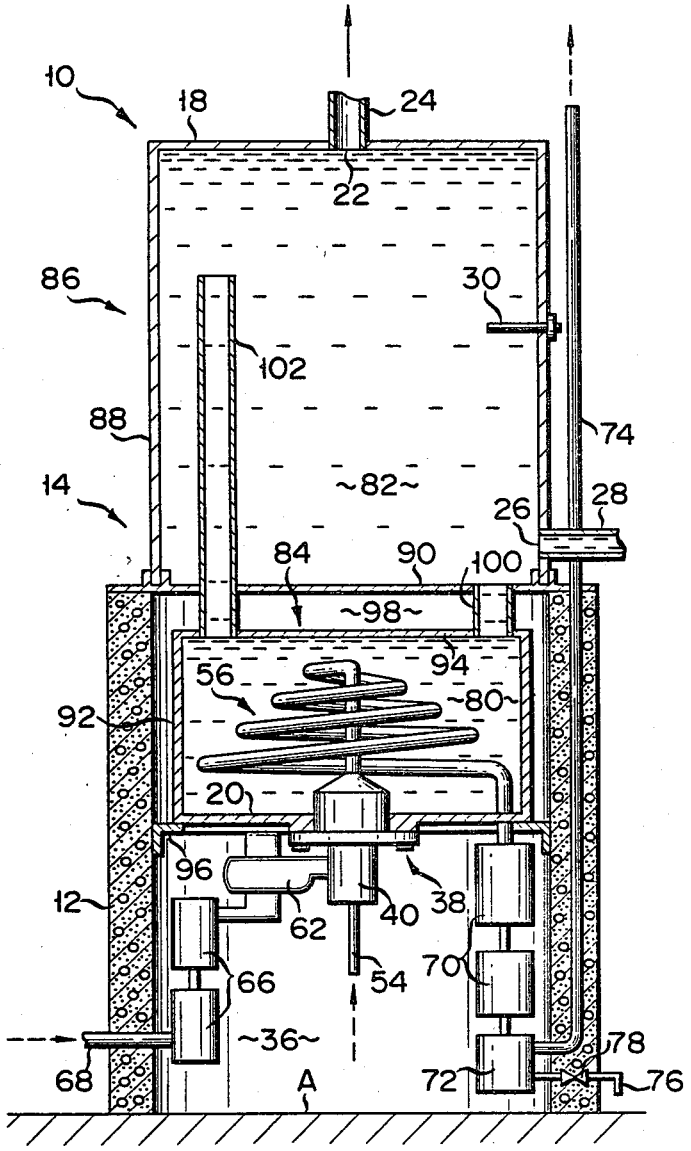
FIG. 3 is a vertical sectional view of a hot water supply system according to the second embodiment of the present invention.

A hot water supply system according to the second embodiment of the present invention will now be described in detail with reference to FIG. 3. The same reference numerals as in FIG. 1 denote the same parts in FIG. 3, and a detailed description thereof will be omitted.

In this embodiment, a storage tank 14 is divided into a first section 80 with a tail pipe 56 housed therein, and a second section 82 communicating with a hot water outlet port 22. The storage tank 14 has a subtank 84 defining the first section 80, and a main tank 86 defining the second section 82. The main tank 86 has a cylindrical circumferential wall 88, an upper end plate 18 closing the upper end opening of the wall 88, and a lower end plate 90 closing the lower end opening of the wall 88. The hot water outlet port 22 is formed in the upper end plate 18, and a hot water discharge pipe 24 is connected to the port 22. A water inlet port 26 is formed in the wall 88 near the lower end plate 90, and a water supply pipe 28 is connected to the port 26. The lower end plate 90 is supported by the upper peripheral edge of a base 12, and closes the upper end thereof. The base 12 has a height about twice that of the first embodiment. The subtank 84 has a cylindrical circumferential wall 92, an upper end plate 94 closing the upper end opening of the wall 92, and a lower end plate 20 closing the lower end opening of the wall 92. The lower end plate 20 is supported by an annular flange 96 mounted at about the vertically central portion of the inner face of the base 12. The lower end plate 20, together with the inner face of the base 12, defines a soundproofing chamber 36 below the lower end plate 20. The lower end plate 20 also defines, together with the inner face of the base 12 and the lower end plate 90, another soundproofing chamber 98 above the lower end plate 20. Therefore, the subtank 84 is arranged inside the soundproofing chamber 98. A pulse burner 40 is attached to the lower end plate 20, and the tail pipe 56 is arranged inside the subtank 84 and hence, inside the first section 80. The storage tank 14 has first and second communicating pipes 100 and 102 which communicate between the first and second sections 80 and 82. One end of the first communicating pipe 100 opens to the lower end plate 90 in the vicinity of the water inlet port 26, and the other end thereof opens to the upper end plate 94. One end of the second communicating pipe 102 opens to the upper end plate 94, and the pipe 102 extends into the second section 82 through the lower end plate 90, while the other end of the second communicating pipe 102 opens to the vicinity of the hot water outlet port 22.

The hot water supply system 10 according to the second embodiment of the present invention and having the construction described above has the following advantages in addition to those of the first embodiment. The liquid inside the second section 82 is supplied to the first section 80 through the first communicating pipe 100 and is heated by the tail pipe 56. The liquid heated therein is supplied to the vicinity of the hot water outlet port 22 through the second communicating hole 102 and is discharged through the hot water outlet port 22. In this manner, the liquid heated inside the first section 80 hardly mix with the liquid inside the second section 82 and is discharged through the hot water outlet port 22 while remaining at a high temperature. For this reason, the system of this embodiment is capable of supplying hot water of high temperature within a relatively short period of time. Since the subtank 84 with the tail pipe 56 housed therein is arranged inside the soundproofing chamber 98, noise may be eliminated more reliably than with the first embodiment.

The embodiments described above are only for explanatory purposes, and the present invention is not limited to these embodiments. For example, the descending portion 60 of the tail pipe 56 is spiral or circular in the above embodiments. However, the descending portion may be wound in a rectangular shape. If a large heat exchange area is not required, the descending portion 60 may be a linear portion without being wound. In the above embodiments, the base 12 is made of a soundproofing material. However, the base may be made of any other suitable material and the inner or outer face thereof may be covered with a soundproofing material. In the second embodiment, the first and second sections 80 and 82 are defined by the main tank 86 and the subtank 84 which are separated from each other. However, the first and second sections may be defined by a partition wall in a single tank, and a communicating hole or a communicating pipe may be arranged in this partition wall.

What we claim is:

1. A hot water supply system comprising:

a base of a substantially cylindrical shape;

a storage tank supported on the base, the storage tank having an upper end plate and a lower end plate supported on the base and defining, together with an inner face of the base, a soundproofing chamber;

a pulse combustor including a pulse burner attached to the lower end plate and having a combustion chamber, and a tail pipe for discharging an exhaust gas which tail pipe communicates with the combustion chamber and is arranged inside the storage tank next to the lower end plate to function as a heat exchanger, the tail pipe having an ascending portion which extends upward from the pulse burner, said ascending portion having such a length that condensation of the exhaust gas does not occur in the ascending portion, and a descending portion which spirally extends from the topmost end of the ascending portion toward the lower end plate in such a manner that it is located around the ascending portion, said descending portion extending into the soundproofing chamber through the lower end plate to discharge water generated during combustion which condenses in the descending portion;

a blower arranged inside the soundproofing chamber to supply air to the pulse burner at an earlier stage of combustion;

a suction muffler arranged inside the soundproofing chamber and communicating with the blower;

an exhaust muffler arranged inside the soundproofing chamber and communicating with the descending portion of the tail pipe; and wherein the base includes a soundproofing layer to shield noises generated in the soundproofing chamber.

2. A system according to claim 1, wherein said pulse burner includes a lower half located within the soundproofing chamber, and an upper half projecting into the storage tank through the lower end plate, the ascending portion of the tail pipe extending from the upper half of the pulse burner.

3. A system according to claim 1, wherein said ascending portion of the tail pipe vertically extends toward the upper end plate and the descending portion spirally extends toward the end plate in such a manner that it is located around the ascending portion with the diameter of the spiral continuously increasing toward the lower end plate.

4. A system according to claim 1, wherein said storage tank has a circumferential wall of substantially cylindrical shape, which has a water inlet port adjacent to the lower end plate, and the upper end plate has a hot water outlet port.

5. A system according to claim 4, wherein said lower end plate is detachably attached to the circumferential wall and is supported on an upper peripheral edge of the base.

6. A system according to claim 1, wherein said storage tank has a first section in which the tail pipe is located, and a second section communicating with the hot water outlet port, the first and second sections communicating with each other.

7. A system according to claim 6, wherein said storage tank has a subtank, a main tank and first and second communicating pipes communicating the subtank with the main tank, the subtank defining the first section and having the lower end plate, another upper end plate and a circumferential wall, and the main tank defining the second section and having the upper end plate, another lower plate and a circumferential wall.

8. A system according to claim 7, wherein said another lower end plate is supported on an upper peripheral edge of the base to seal an upper end of the base, the lower end plate is supported at substantially the center of an inner face of the base along an axial direction thereof and defines the soundproofing chamber, together with the inner face of the base, below the lower end plate and defines another soundproofing chamber, together with the inner face of the base and the another lower end plate, above the lower endplate, and the subtank being arranged inside the another soundproofing chamber.

9. A system according to claim 8, wherein said circumferential wall of the main tank has a water inlet port formed therein adjacent to the another lower end plate, the first communicating pipe has one end opening to the another lower end plate in the vicinity of the water inlet port and the other end opening to the another upper end plate, the second communicating pipe has one end opening to the another upper end plate and the other end opening to the second section in the vicinity of the hot water outlet port, the second communicating pipe extending from the one end thereof through the another lower end plate into the second section.

10. A system according to claim 9, wherein said pulse burner has a lower half located within the soundproofing chamber, and an upper half projecting into the first section through the lower end plate, the ascending portion of the tail pipe extending from the upper half of the pulse burner.

11. A system according to claim 10, wherein said descending portion of the tail pipe is wound to extend toward the lower end plate.

12. A system according to claim 11, wherein said descending portion of the tail pipe is wound to extend spirally toward the lower end plate.

13. A system according to claim 12, wherein said ascending portion of the tail pipe extends vertically toward the upper end plate, and the descending portion is wound to extend spirally toward the lower end plate around the ascending portion.

14. A system according to claim 1, wherein said base is made of a soundproofing material.

15. A system according to claim 1, further comprising a drain tank which is arranged inside the soundproofing chamber and which is connected to the exhaust muffler, a drain pipe which extends from the drain tank through the base to the outside thereof, a solenoid valve for opening/closing the drain pipe, and an exhaust pipe which extends from the drain tank through the base to the outside thereof.

16. A system according to claim 1, further comprising a suction pipe which extends from the suction muffler through the base to the outside thereof.

* * * * *